US007281764B2

(12) United States Patent
Thole

(10) Patent No.: US 7,281,764 B2
(45) Date of Patent: Oct. 16, 2007

(54) TENSION CONTROL MECHANISM FOR CHAIR

(75) Inventor: Doug Thole, Grand Rapids, MI (US)

(73) Assignee: Haworth, Inc., Holland, MI (US)

( * ) Notice: Subject to any disclaimer, the term of this patent is extended or adjusted under 35 U.S.C. 154(b) by 584 days.

(21) Appl. No.: 10/749,309

(22) Filed: Dec. 31, 2003

(65) Prior Publication Data

US 2004/0160101 A1 Aug. 19, 2004

Related U.S. Application Data

(63) Continuation of application No. 10/274,425, filed on Oct. 18, 2002, now abandoned.

(60) Provisional application No. 60/330,180, filed on Oct. 18, 2001.

(51) Int. Cl.
*A47C 1/024* (2006.01)

(52) U.S. Cl. ..... 297/303.4; 297/303.5; 297/300.5; 297/300.8

(58) Field of Classification Search ..... 297/300.1, 297/300.5, 300.8, 301, 303.4, 303.5
See application file for complete search history.

(56) References Cited

U.S. PATENT DOCUMENTS 626,521 A * 6/1899 Benjamin ..... 297/181
2,321,385 A * 6/1943 Herold ..... 297/300.5
2,365,200 A * 12/1944 Lorenz ..... 297/292
2,615,496 A * 10/1952 Lorenz et al. ..... 297/83
2,784,767 A * 3/1957 Soderberg ..... 297/300.4
2,859,801 A * 11/1958 Moore ..... 297/322
4,009,856 A * 3/1977 Wolters et al. ..... 248/596
4,270,797 A * 6/1981 Brauning ..... 297/300.3
4,479,679 A * 10/1984 Fries et al. ..... 297/300.5
4,502,729 A * 3/1985 Locher ..... 297/300.3
4,537,445 A * 8/1985 Neuhoff ..... 297/300.3
4,652,050 A * 3/1987 Stevens ..... 297/303.4
4,653,806 A * 3/1987 Willi ..... 297/300.5
4,682,814 A * 7/1987 Hansen ..... 297/300.3
4,685,730 A * 8/1987 Linguanotto ..... 297/316
4,695,093 A * 9/1987 Suhr et al. ..... 297/303.4
4,709,962 A * 12/1987 Steinmann ..... 297/300.3
4,758,045 A * 7/1988 Edel et al. ..... 297/300.2
4,773,706 A * 9/1988 Hinrichs ..... 297/300.5
4,979,778 A * 12/1990 Shields ..... 297/300.2
5,026,117 A * 6/1991 Faiks et al. ..... 297/300.5
5,042,876 A * 8/1991 Faiks ..... 297/301.4

(Continued)

FOREIGN PATENT DOCUMENTS

DE 3737491 A * 5/1989

(Continued)

*Primary Examiner*—Laurie K. Cranmer
(74) *Attorney, Agent, or Firm*—Flynn, Thiel, Boutell & Tanis, P.C.

(57) ABSTRACT

The chair includes seat and back assemblies interconnected in a four-bar linkage. The chair further includes a tension mechanism comprising a coil spring projecting forwardly from a base and an adjustment linkage which is connected to said coil spring and to a front link of said four-bar linkage. A back linkage end of said adjustment linkage being axially movable along an axis of said coil spring and a front linkage end being vertically movable along said front link to adjust displacement of said adjustment linkage during rearward pivoting of said front link.

12 Claims, 13 Drawing Sheets

U.S. PATENT DOCUMENTS 5,071,189 A * 12/1991 Kratz ..... 297/300.1
5,160,184 A * 11/1992 Faiks et al. ..... 297/300.5
5,195,801 A * 3/1993 Franck et al. ..... 297/300.5
5,203,853 A * 4/1993 Caruso ..... 297/303.3
5,207,479 A * 5/1993 Wickman et al. ..... 297/303.4
5,209,548 A * 5/1993 Locher ..... 297/300.4
5,308,144 A * 5/1994 Korn ..... 297/300.2
5,328,237 A * 7/1994 Yamaguchi et al. ..... 297/303.4
5,354,120 A * 10/1994 Volkle ..... 297/300.1
5,375,912 A * 12/1994 Stulik et al. ..... 297/302.4
5,772,282 A * 6/1998 Stumpf et al. ..... 297/302.3
5,775,774 A * 7/1998 Okano ..... 297/300.2
5,918,935 A * 7/1999 Stulik et al. ..... 297/300.5
5,964,503 A * 10/1999 Inoue ..... 297/300.4
6,000,755 A * 12/1999 Uhlenbrock ..... 297/300.2

FOREIGN PATENT DOCUMENTS

DE 3817761 A * 11/1989
DE 3834614 A * 4/1990
EP 0247312 A * 12/1987
EP 0250207 B * 12/1987
EP 0271600 A * 6/1988
EP 0960586 A * 12/1999
FR 2461472 * 2/1981
GB 1165135 * 9/1969

* cited by examiner

TENSION CONTROL MECHANISM FOR CHAIR

CROSS REFERENCE TO RELATED APPLICATION

This application claims the benefit of U.S. Provisional Application No. 60/330,180, filed Oct. 18, 2001.

This is a continuation of Ser. No. 10/274,425, filed Oct. 18, 2002 now abandoned.

FIELD OF THE INVENTION

The invention relates to an office chair having a tilt control with an improved tension mechanism.

BACKGROUND OF THE INVENTION

Conventional office chairs frequently have a tiltable seat assembly which tilts downwardly during rearward tilting of a back assembly. Such chairs include a tilt control mechanism which controls tilting of the seat and back assemblies and includes a tension arrangement which normally biases the chair to an upright position. Such tension mechanisms also include an adjustment mechanism for adjusting the return force generated thereby.

The invention relates to an improved tension control mechanism for adjusting the return force generated by a coil spring. The seat and back assemblies in this chair are functionally and structurally interconnected together in a four-bar linkage arrangement wherein the tension control mechanism includes an adjustment linkage connected between the coil spring and a front link of the four-bar linkage. An actuator adjusts a front end of the adjustment linkage vertically along the front link to vary the operating characteristics thereof and thereby adjusts the return force.

Other objects and purposes of the invention, and variations thereof, will be apparent upon reading the following specification and inspecting the accompanying drawings.

Figure 1A:
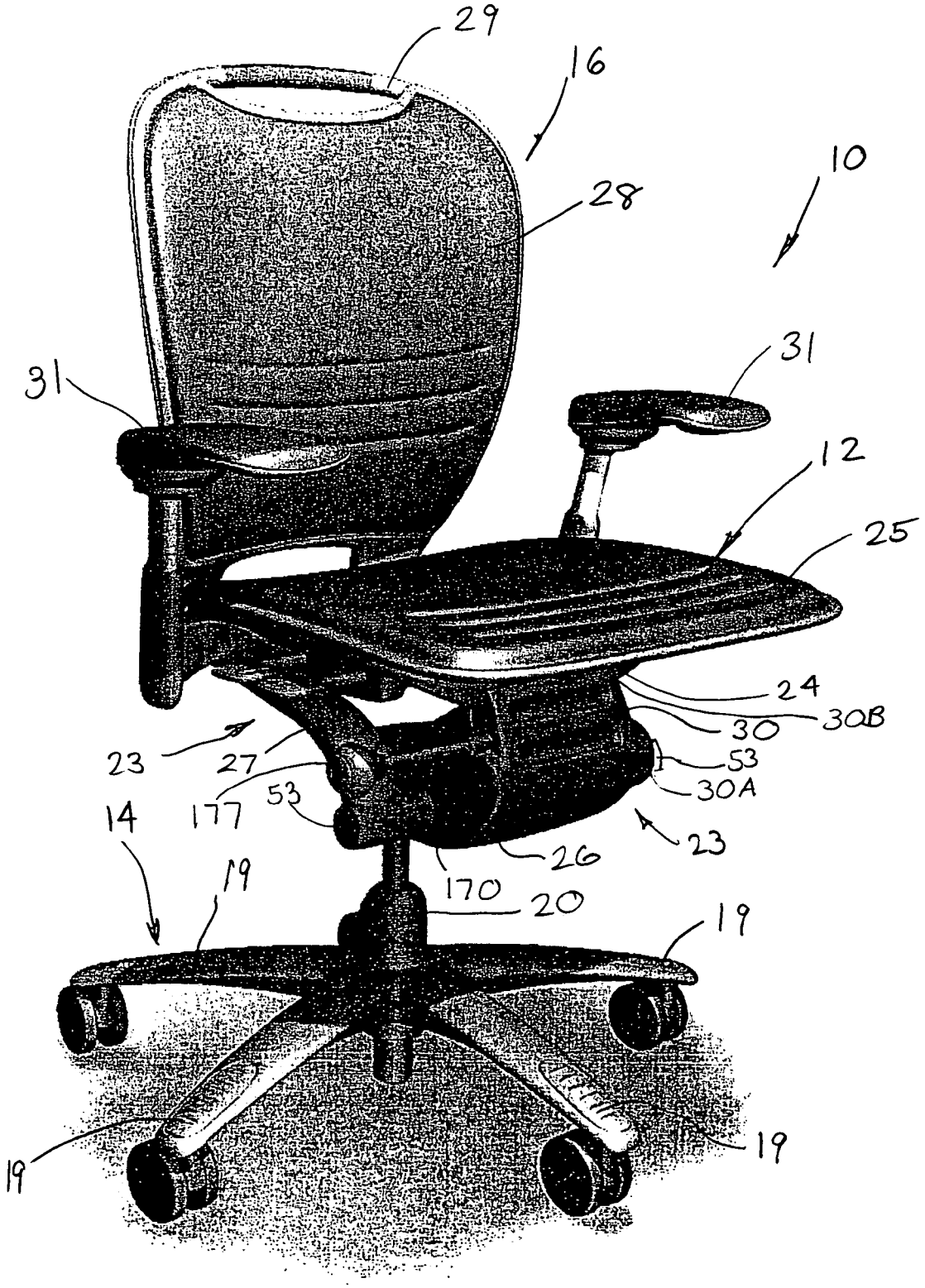
FIG. 1A is a perspective view of a chair having a tilt control connecting a seat-back assembly to a pedestal.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the system and designated parts thereof. Said terminology will include the words specifically mentioned, derivatives thereof, and words of similar import.

DETAILED DESCRIPTION

Figure 1B:
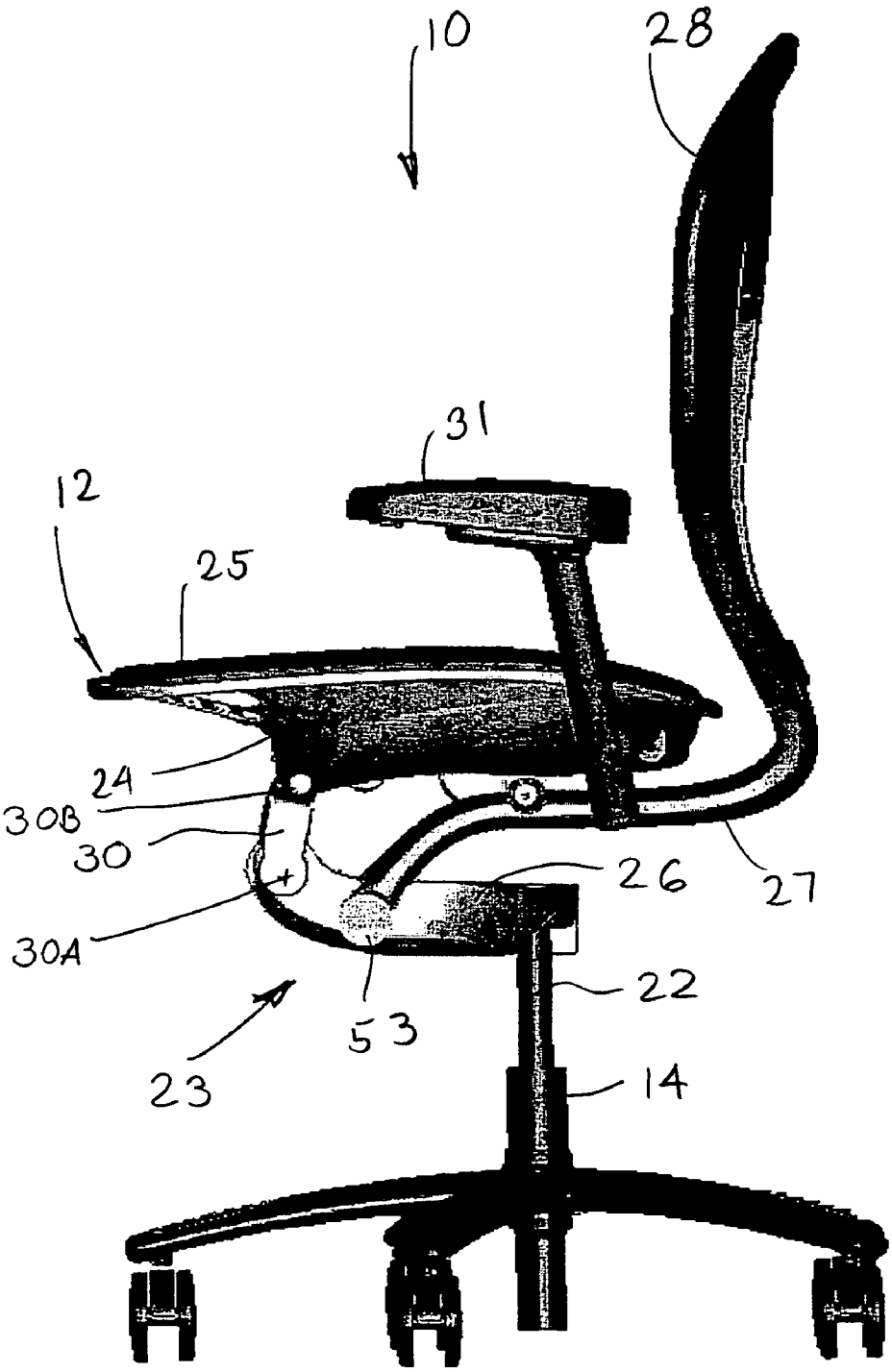
FIG. 1B is a side elevational view of the chair in a normal upright position.

Referring to FIGS. 1A and 1B, a chair 10 is illustrated having a seat-back arrangement comprising a seat unit 12 supported on a pedestal or base 14 and a back unit 16 pivotally connected to the pedestal 14.

Generally, the office chair 10 includes the pedestal 14 having legs 19 radiating outwardly from a lower end of a vertical post 20. The outer ends of the legs 19 include conventional casters which support the office chair 10 on a floor or other similar surface.

The upper end of the pedestal post 20 rigidly supports the seat unit 12 thereon by a tilt control 23. The pedestal post 20 also includes a pneumatic cylinder 22 (FIG. 1B) which permits raising and lowering of the seat unit 12. In particular, the tilt control 23 includes a structural seat frame 24 and a horizontally enlarged suspension seat assembly 25 which seat assembly 25 overlies and is supported on the seat frame 24.

Figure 1C:
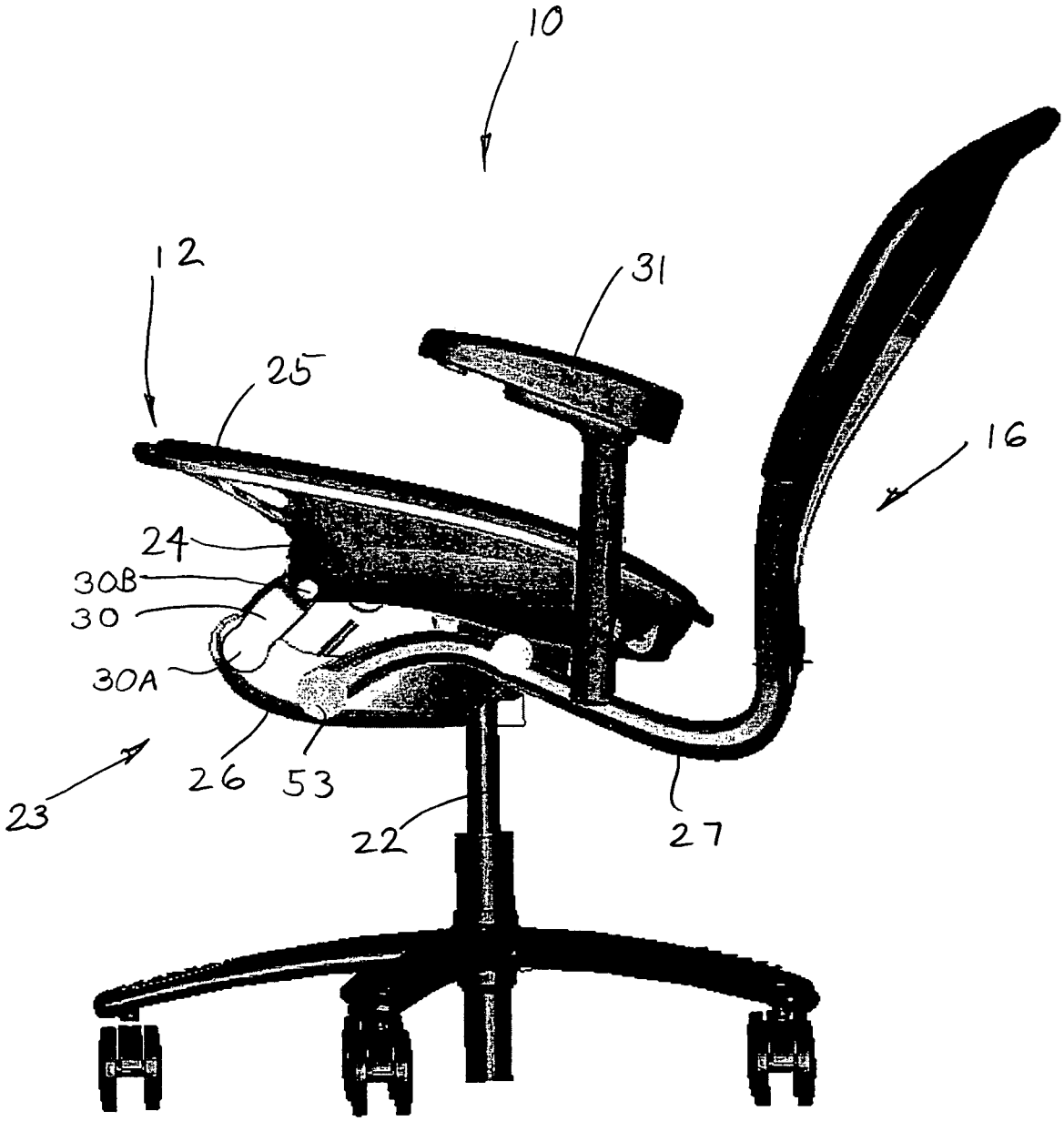
FIG. 1C is a side elevational view of the chair in a rearwardly tilted position.

Referring to FIGS. 1B and 1C, the tilt control 23 generally includes a rigid control body 26 which is rigidly connected to the pedestal post 20 and is cantilevered outwardly therefrom to define an arm, and an L-shaped upright 27 which has separate lower ends 53 that are pivotally connected to the body 26. The upper end of the upright 27 supports the back unit 16 thereon. The back unit 16 includes a vertically enlarged suspension back assembly 28 that has a suspension fabric which supports the body of the chair occupant and a back frame 29 on which the back assembly 28 is connected.

The base 14 further includes a front link 30 which is pivotally connected at its lower end to the control body 26 forwardly of the upright 27 so as to pivot about pivot axis 30A. The seat frame 23 is pivotally connected to the upper end of the front link 30 at an upper pivot axis 30B and also to the upright 27 to thereby define a four-bar linkage which governs simultaneous tilting of the seat unit 12 and the back unit 16.

For tilting, the tilt control 26 includes a tension mechanism 32 to resist tilting. As a result, rearward tilting of the back unit 16 causes a corresponding downward tilting of the seat unit 12 about the front link 30. A pair of support arms 31 also are connected to opposite sides of the seat frame 23 and move therewith.

Figure 2:
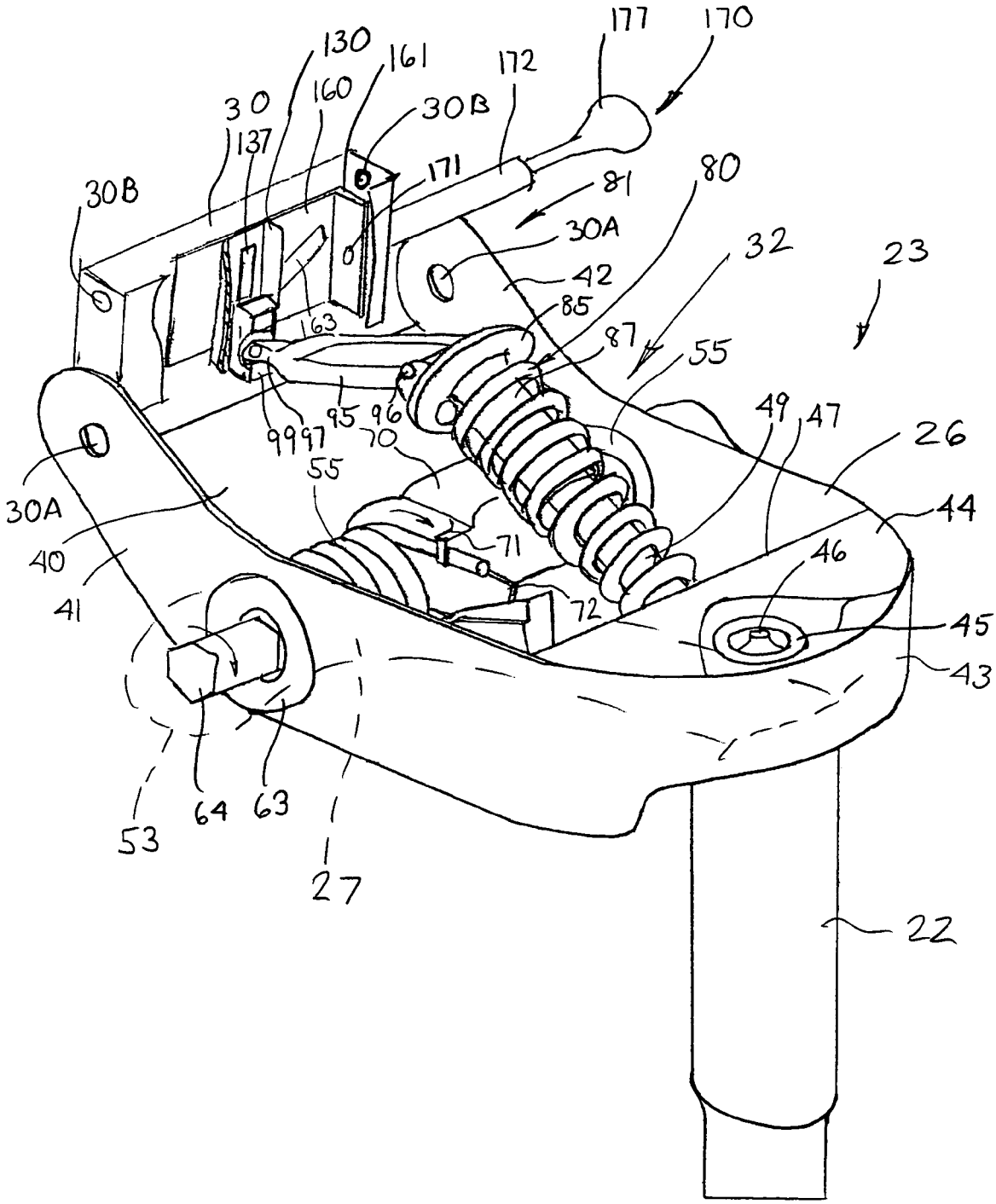
FIG. 2 is an enlarged perspective view of the tilt control and an adjustable tension mechanism thereof.
Figure 3:
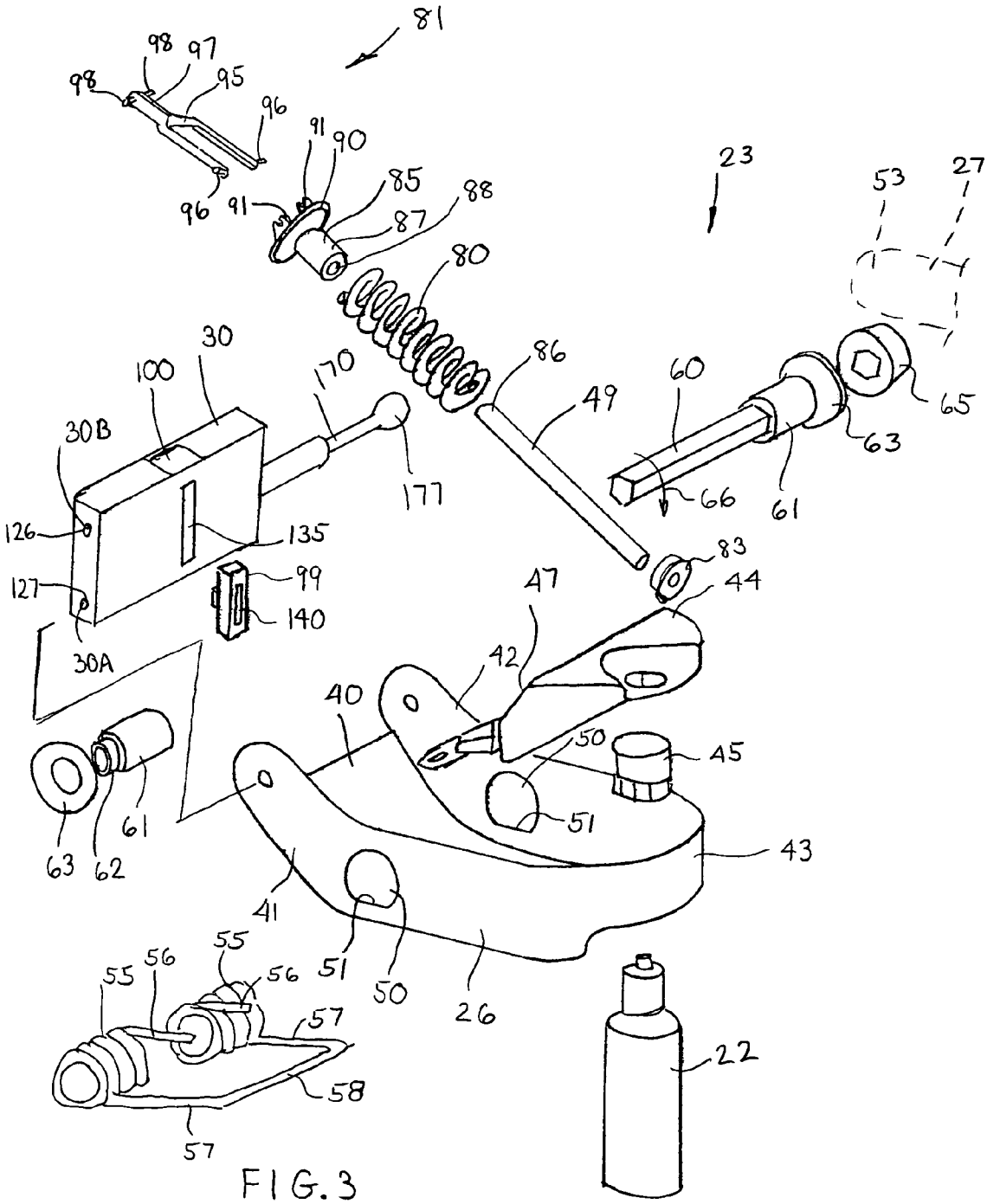
FIG. 3 is an exploded view of the tilt control.
Figure 4:
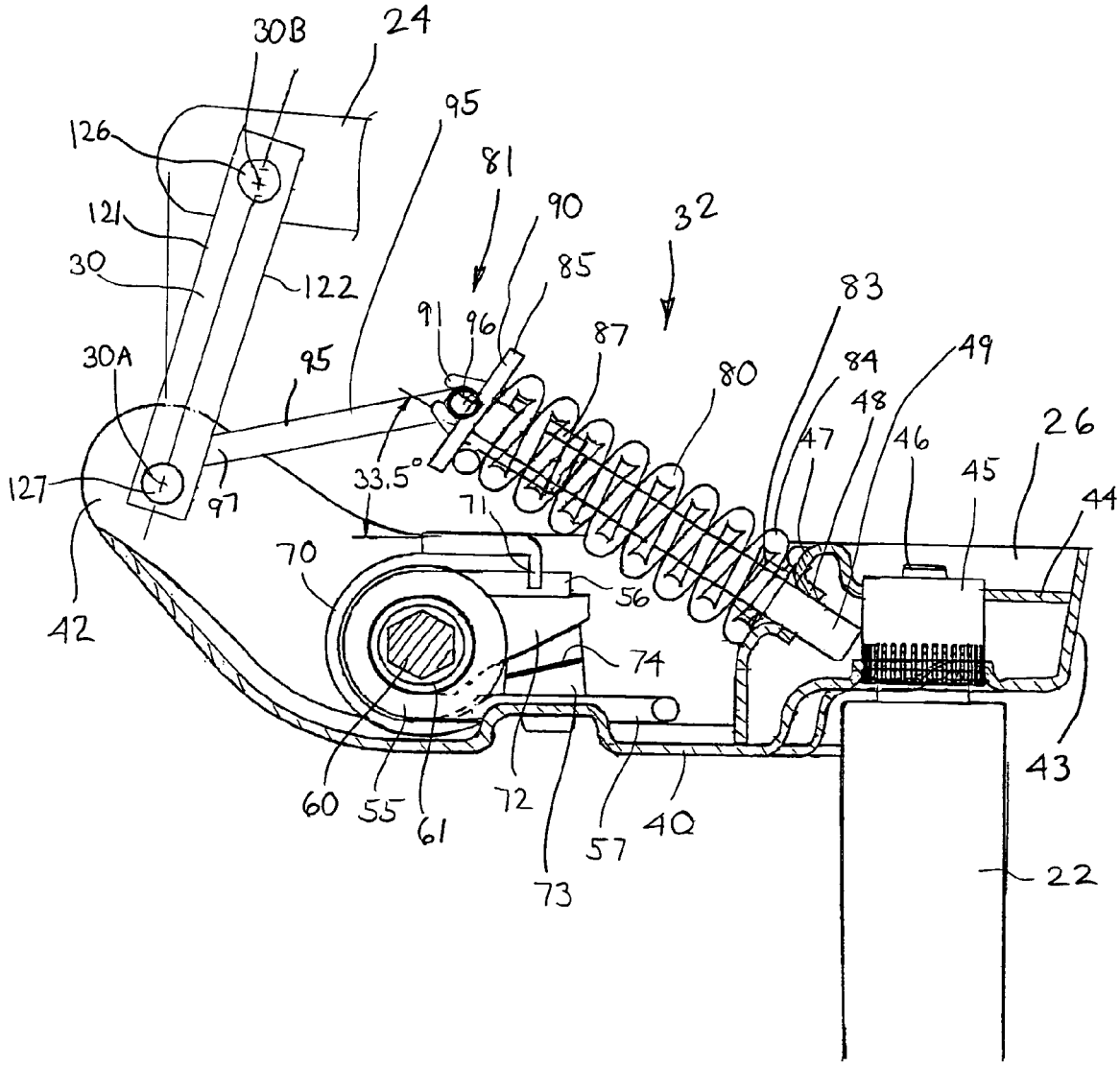
FIG. 4 is a side elevational view of the tilt control illustrating the tension mechanism adjusted to a first tension position.

Referring to the tilt control 23 of FIGS. 2–4, the control body includes a bottom wall 40 and side walls 41 and 42 which extend rearwardly and are joined together by a common back wall 43. A stepped strengthening plate 44 is welded into the back end of the control body 26 and includes a mounting collar 45 which is rigidly attached to the bottom wall 42 and plate 44. The upper end of the pneumatic cylinder 22 is received in the collar 45 wherein the actuator button 46 for the cylinder 22 is accessible vertically therefrom. As such, the control body 26 is rigidly connected to the pedestal 14 and projects forwardly in cantilevered relation away from the upper end of the cylinder 22.

The strengthening plate 44 also includes an inclined front wall 47 having a mounting bore 48 angling downwardly therethrough. A rigid, rod-like support post 49 is rigidly fitted into the mounting bore 48 and welded in place. The post 49 angles upwardly at an angle of approximately 33.5 degrees relative to the bottom body wall 40.

The side walls 41 and 42 further include pivot openings 50. The pivot openings 50 are generally circular except that they include flat bottom edges 51. The pivot openings 50 define the locations at which the lower ends 53 of the upright 27 are pivotally connected to the control body 26. The lower sections 53 of the upright 27 in particular are pivotally connected to and cooperate with the control body 26 through the tension mechanism 32. As a result, the tension mechanism 32 resists rearward tilting of the upright 27 and generates a resilient restoring force which biases the upright 27 to the non-tilted position of FIG. 1A.

As described herein, the tension mechanism 32 provides a primary spring load or force which is non-adjustable, as well as an additional adjustable spring load to allow the overall restoring force to be adjusted to accommodate the unique characteristics of the different users who use the chair 10.

As for the fixed-load spring arrangement, this arrangement includes a torsional spring arrangement comprising a pair of coil springs 55 having free upper spring legs 56 and respective lower spring legs 57. The lower spring legs 57 are joined together by a transverse spring section 58.

To support the springs 55, a pivot shaft 60 is provided which extends horizontally between the openings 50. The shaft 60 has a hexagonal cross-sectional shape or other non-circular geometric shape and includes cylindrical bushings 61 at the opposite ends thereof. The outermost ends of the cylindrical bushings each include a reduced-diameter end section 62 which fits into the opening 50 while the innermost portions of the bushing 61 are disposed in the control body 26 within the hollow interiors of the coil springs 55. The coil springs 55 thereby are supported on the pivot shaft 60 by the bushings 61.

The pivot shaft 60 also includes washers 63 which are located on the outside of the control body side walls 41 and 42. The outer ends 64 of the shaft 60 project out of the control body 26 and are fixedly connected to the lower ends 53 of the uprights 27 so as to be connected thereto by a connector 65. As such, rearward pivoting of the uprights 27 causes the pivot shaft 60 to rotate in the clockwise direction of reference arrow 66 (FIG. 3).

Figure 6:
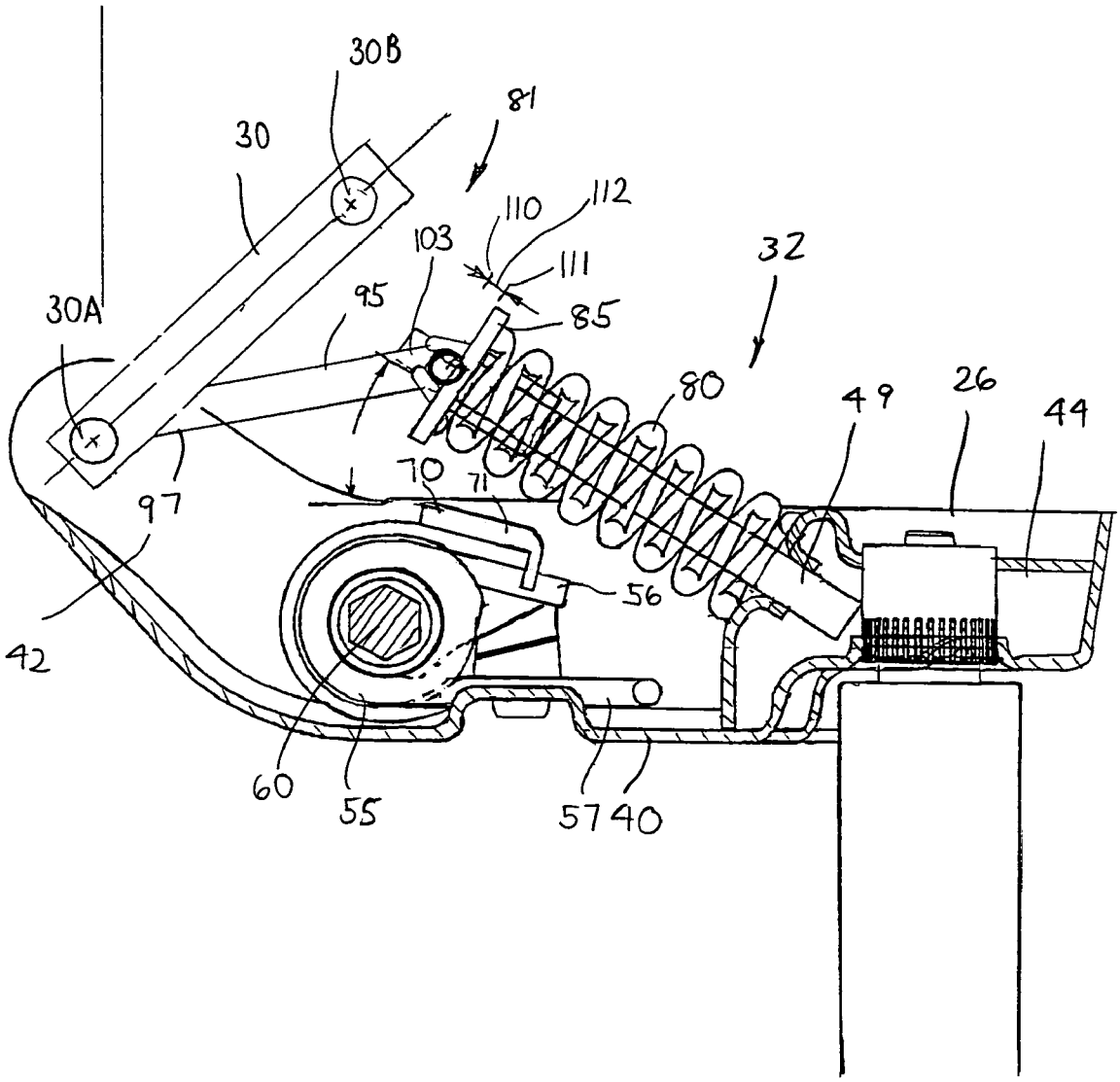
FIG. 6 is a side elevational view illustrating the tension mechanism in the first position when the chair is tilted.

When the springs 55 are mounted in place, the lower spring legs 57 abut against the control body bottom wall 40 and act downwardly thereon. The upper spring legs 56 project rearwardly and are connected to the shaft 60 by a connector body 70. The connector body 70 has a bore extending sidewardly therethrough which has a hexagonal shape that corresponds to the shape of the shaft 60 and therefore is keyed so as to rotate in unison with the shaft 60. The connector body 70 includes yoke-like arms 71 which respectively engage the upper spring legs 56. Therefore, upon rearward tilting of the upright 27 as generally indicated in FIG. 6, the yokes 71 rotate with the shaft 60 which causes downward deflection of the spring legs 56. This generates a torsional spring force or load which acts in the opposite direction on the yoke 71 to resist tilting of the upright 27 and restore the chair 10 to the fully upright position.

To lock out rearward tilting, the connector body 70 also includes a rearwardly projecting arm 72, and a lock-out block 73 is provided generally below the arm 72. The block 73 includes an upward facing stop surface 74. The block 73 is slidable sidewardly by a suitable drive mechanism so that when located in a first position, the stop surface 74 is clear of the arm 72 to permit rotational movement of the arm 72. However, to lock out rearward tilting, the block 73 may be moved sidewardly to an interference position wherein the arm 72 contacts the stop surface 74 to prevent rotation of the shaft 60 and lock out tilting.

The spring force generated by the springs 55 is not adjustable and is selected so as to provide the primary restoring force on the upright 27.

To adjust the chair 10 to accommodate different users, however, an additional adjustable spring 80 is provided which also generates a restoring force which resists tilting of the chair. This restoring force, however, may be adjusted as described hereinafter.

The spring 80 is mounted to the control body 26 and cooperates with an adjustment linkage 81 to apply a biasing force directly to the front seat link 30. More particularly, the spring 80 is mounted on the support post 49 of the control body 26. The support post 49 receives a lower bushing 83 formed of any suitable material such as plastic. The lower end 84 of the spring 80 is fitted onto the bushing 83 so as to be centered thereby and abuts against the face of the inclined wall 47.

An additional slide bushing 85 is provided on the outermost end 86 of the post 49. The slide bushing 85 includes a narrow cylindrical portion 87 having a bore 88 formed therethrough. The post 49 is received through the bore 88 wherein the narrow portion 87 is fitted within the interior of the coil spring 80. The bushing 85 includes an annular rim 90 projecting outwardly therefrom which abuts against the outer end of the spring 80. The flange 90 further includes a pair of connector flanges 91 which project forwardly therefrom.

An adjustment link 95 is pivotally connected to the bushing 85 and the front link 30 to transfer the axial spring force of the spring 80 to the front link 30. In particular, the adjustment link 95 includes a pair of pivot pins 96 which are pivotally connected to the respective flanges 91 of the bushing 85 and define a horizontal pivot axis thereat. The front end 97 of the adjustment link 95 also includes a pair of pivot pins 98 which are pivotally connected to a slidable block or bushing 99 and define a horizontal pivot axis. This slide block 99 is received within a vertical channel 100 formed in the front link 30 and is vertically slidable therein to adjust the radial distance between the front link end 97 and the pivot axis 30A.

Figure 5:
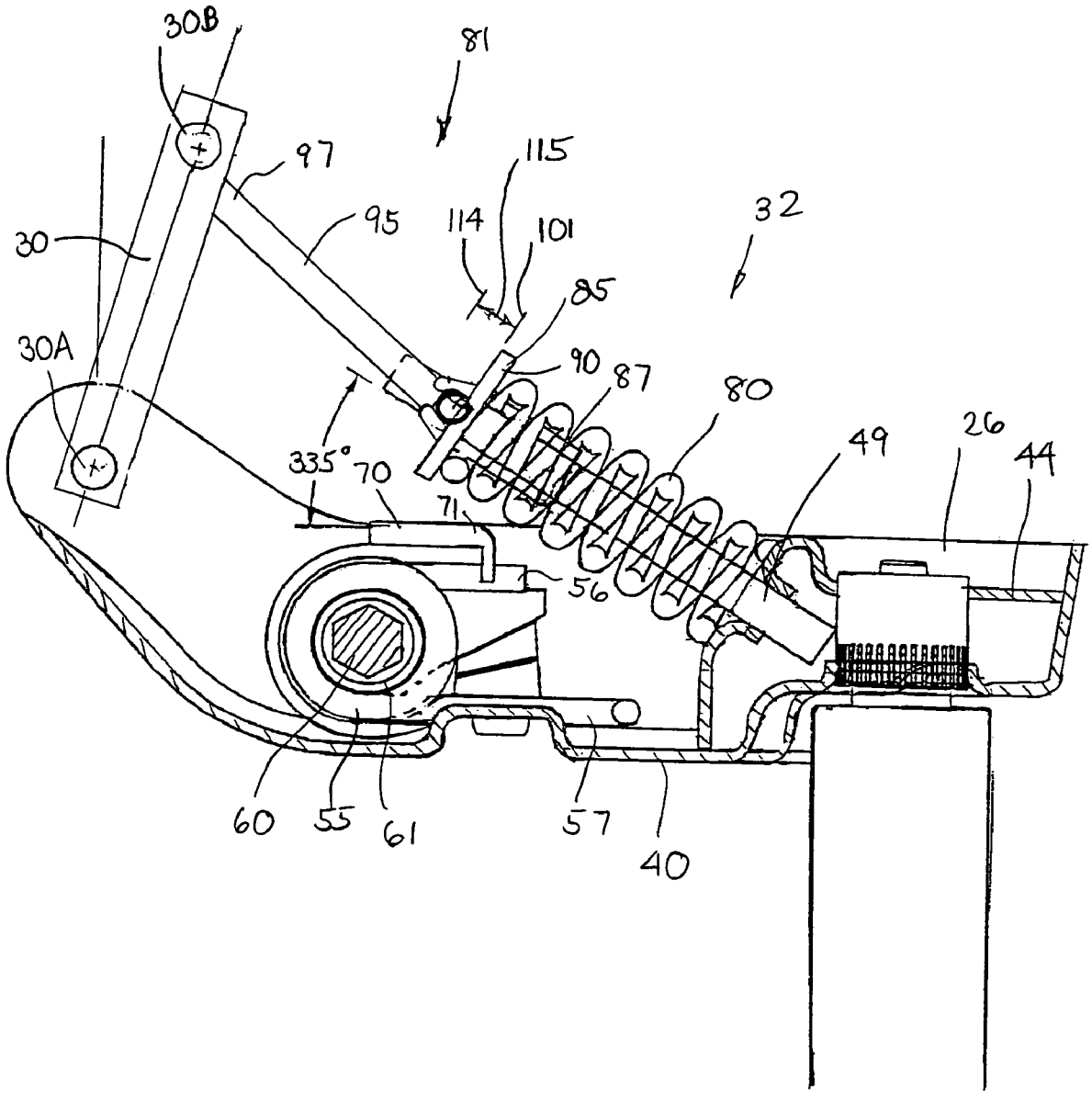
FIG. 5 is a side elevational view of the tilt control illustrating the tension mechanism in a second tension position.

Referring to FIG. 4, the slide block 99 may be positioned radially close to the pivot axis 30A or may be vertically slid along the link 30 to a remote position illustrated in FIG. 5 wherein the front link end 97 is radially close to the pivot axis 30B. By the connection of the adjustment link 95 to the front link 30 and the bushing 85, pivoting or angular movement of the front link 30 can be used to displace the link 95 and compress the spring 80 wherein the spring 80 serves to resist pivoting of the front link 30.

For example, when the slide block 99 is located near the outer end of the front link 30 near the pivot axis 30B as seen in FIG. 5, and when the chair is in its upright position, the spring 80 is compressed only a relatively low amount.

Figure 7:
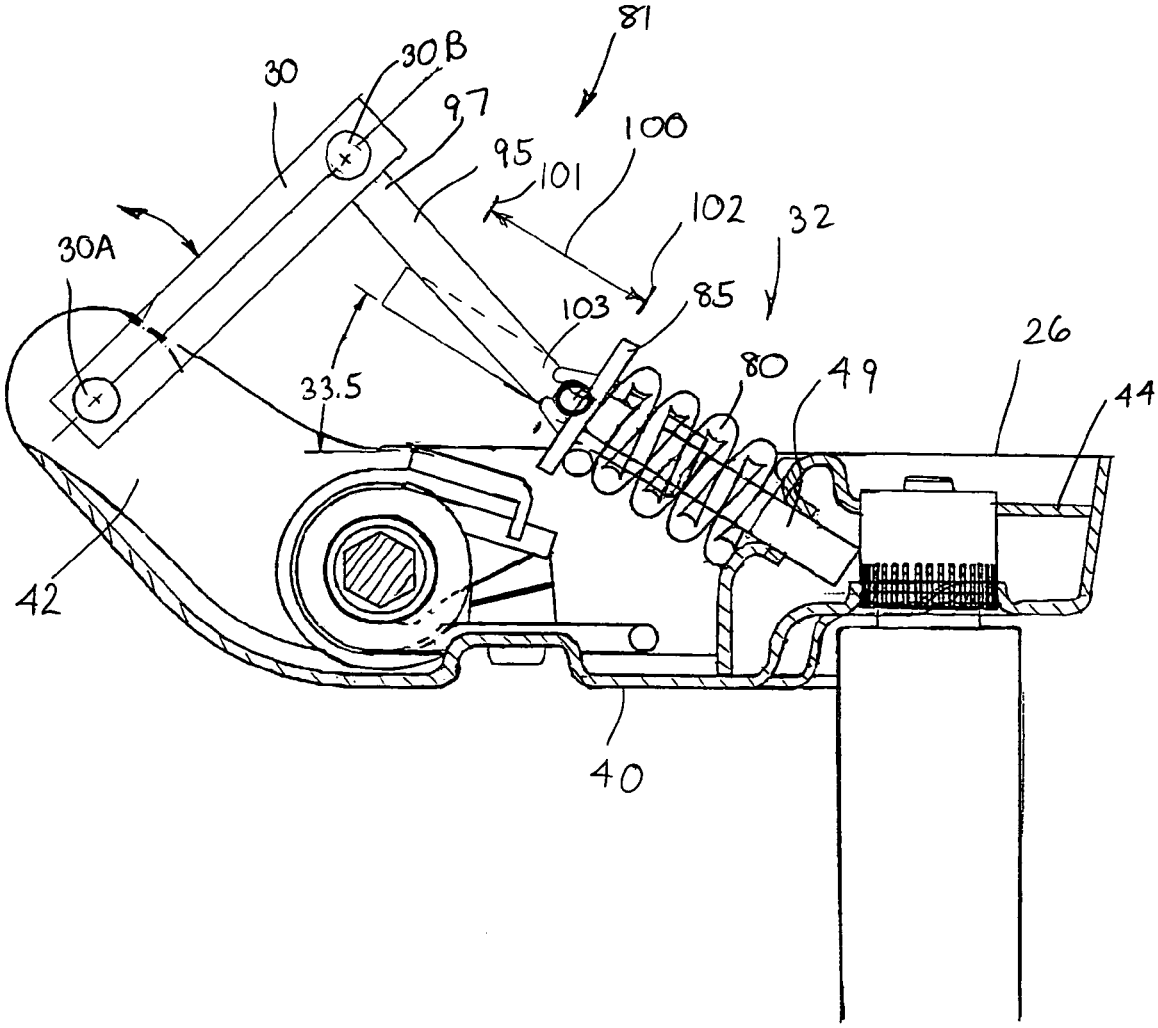
FIG. 7 is a side elevational view illustrating the tension mechanism in the second tension position when the chair is tilted.
Figure 8:
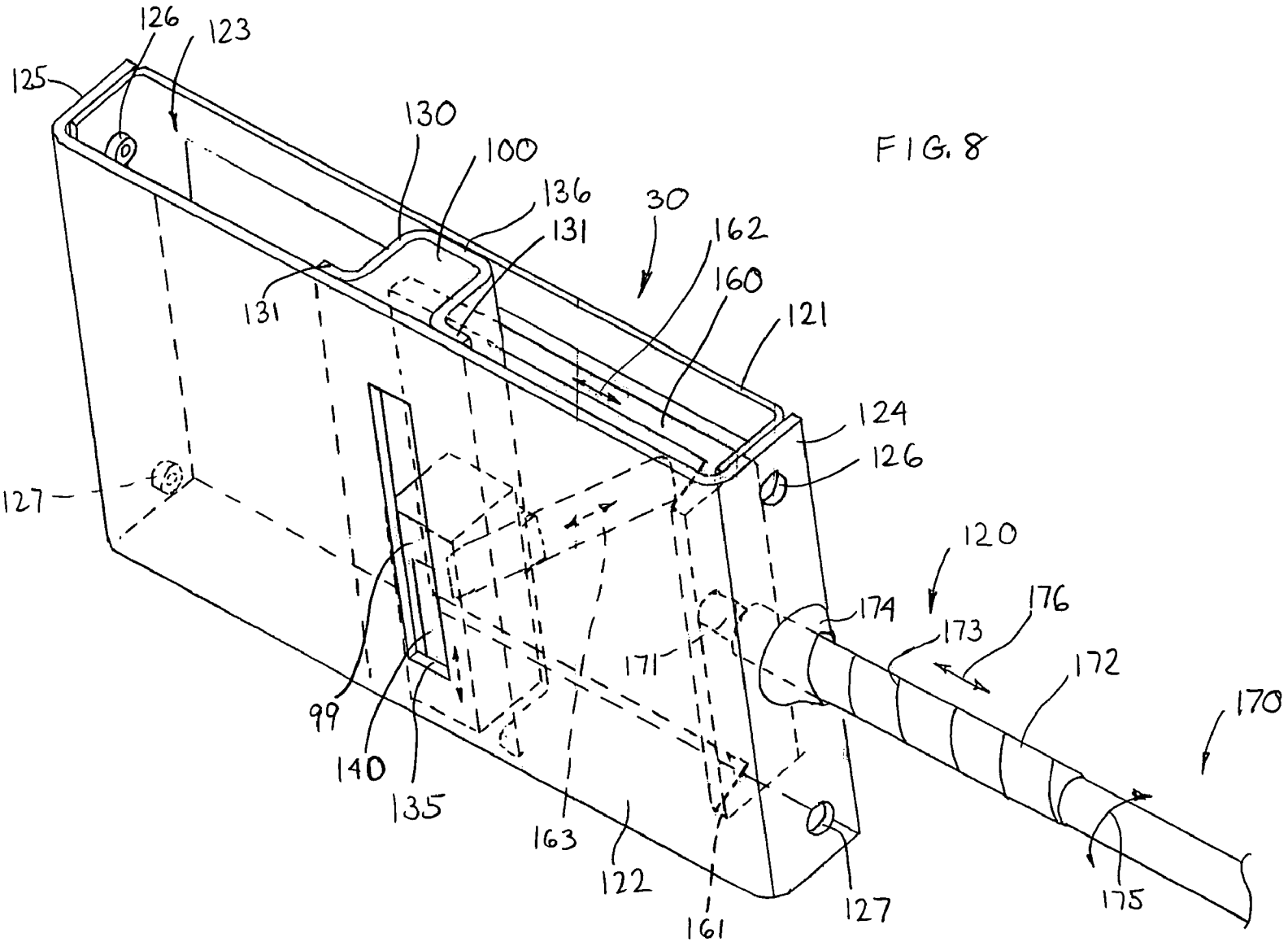
FIG. 8 is a perspective view of a front link of the chair and the actuator mechanism for adjusting the tension mechanism.

However, as seen in FIG. 7, rearward tilting of the chair causes the front link 30 to pivot rearwardly about the axis 30A which causes the link 95 to be driven rearwardly and downwardly along an angular path centered about the pivot axis 30A. This causes a corresponding movement of the bushing 85 along the post 49 so as to compress the spring 80. The amount of compression is generally indicated by reference distance 100 which depicts the linear displacement of the bushing 85 from the initial start position 101 to the final position 102.

Since the bushing 85 is slidable along the post 49, the bushing 85 is constrained to a linear movement along the post 49. In accord therewith, compression of the spring 80 is constrained to an axial compression. The pivot connections between the opposite ends of the adjustment link 95 and the front link 30 and bushing 85 serves to translate the angular motion of the front link end 97 into a linear motion of the back link end 103.

Since the front link end 97 is located at its closest position to the pivot axis 30B in FIG. 7 and as such is most distant from the center axis 30A, the angular displacement of the front link end 97 is at its maximum and in accord therewith, the linear displacement of the back link end 103 is also at its maximum. As such, when the link 95 is in the position illustrated in FIGS. 5 and 7, the total spring load between the spring 55 and the spring 80 is at its maximum. To reduce this overall spring force, the front link end 97 is selectively adjusted downwardly towards the pivot axis 30A as seen in FIGS. 4 and 6 which serves to reduce the total amount of compression of the spring 80 during rearward tilting of the chair.

More particularly referring to FIGS. 4 and 6, the front link end 97 may be positioned at its closest location adjacent to the pivot axis 30A which significantly reduces the angular displacement of the front link end 97 during tilting of the chair. This thereby minimizes the linear or axial displacement of the bushing 85. For example, the initial upright position of FIG. 4 is identified by reference line 110 in FIG. 6. During rearward tilting of the chair, the front link 30 pivots rearwardly which causes the front link end 97 to also pivot rearwardly since the front link end 97 is spaced radially from axis 30A. This causes the back link end 103 to be displaced although this displacement is limited to linear displacement by the sliding engagement or cooperation of the bushing 85 with the post 49. As such, the bushing 85 is displaced a relatively small amount to the position illustrated by reference line 111 wherein the overall displacement 112 is significantly less than the total displacement of the spring 80 as indicated by reference line 100. As such, the majority of the tilt resistance is provided solely by the springs 55 while only a minimal amount of additional tilt resistance is provided by the spring 80. The link 95 when in the position of FIG. 6 defines the lowest spring load for the tension mechanism.

It will be understood that the front link end 97 may be positioned at any intermediate position between the upper limit of travel of FIG. 5 and the lower limit of travel of FIG. 4 to set the amount of compression of the spring 80 to a magnitude which is between the minimum compression 112 and the maximum compression 100. By varying the magnitude of the linear compression of the spring 80, the overall tilt resistance is selectively adjusted to accommodate the unique characteristics of the user.

As an additional matter, the geometry of the front link 30, adjustment link 95 and the bushing 85 is selected so as to increase the pre-tension of the spring 80 when the link 95 is in its upper limit of travel. More particularly, when the link 95 is in its lower position of travel (FIG. 4), it is closest to the end of the post 49. This position is also indicated by reference line 114 in FIG. 5. When the front link end 97 is moved to its upper limit of travel (FIG. 5), the bushing 85 is moved downwardly to the position 101 whereby the spring 80 is compressed by the amount indicated by reference line 115. Thus, the preload on the spring 80 is increased due to displacement of the bushing 85 by the distance 115. This preload is governed by the geometric relationship of the components and may also be modified, for example, by increasing the angle of the fixed post 49 relative to the control body bottom wall 40 during manufacturing of the control body 26.

Referring now to FIGS. 8–13, the front link 30 is configured to slidably support the slide block 99 and includes an actuator mechanism 120 for selectively moving the slide block 99.

More particularly, the front link 30 is configured generally as a box formed by a pair of mating U-shaped plates 121 and 122. The plates 121 and 122 define a hollow interior 123. When mated together, the opposite end walls 124 and 125 of the front link 30 include upper openings or apertures 126 and lower openings or apertures 127. The upper openings 126 are pivotally connected to the seat frame 24 by pivot pins 133 to define the pivot axis 30B. Additionally, the lower apertures 127 are pivotally connected to the control body side walls 41 and 42 by pivot pins 134 to thereby define the pivot axis 30A.

A generally U-shaped channel member 130 is fitted vertically within the hollow interior 123 and includes flanges 131 which are rigidly fixed to the opposing surface of the front plate 122. The channel member 130 thereby defines the vertical slot 100 which is open on its upper and lower ends.

Figure 13:
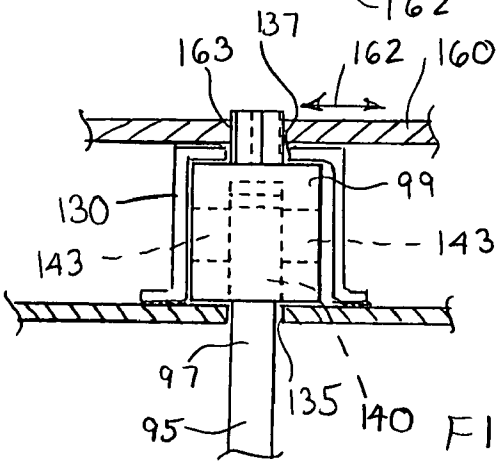
FIG. 13 is a top cross-sectional view of the actuator mechanism.

To provide access to the slide block 99, the front plate 122 includes a vertically elongate slot 135. Additionally, the back wall 136 of the channel 130 also includes a vertically elongate slot 137 as seen in FIG. 13.

Figure 10:
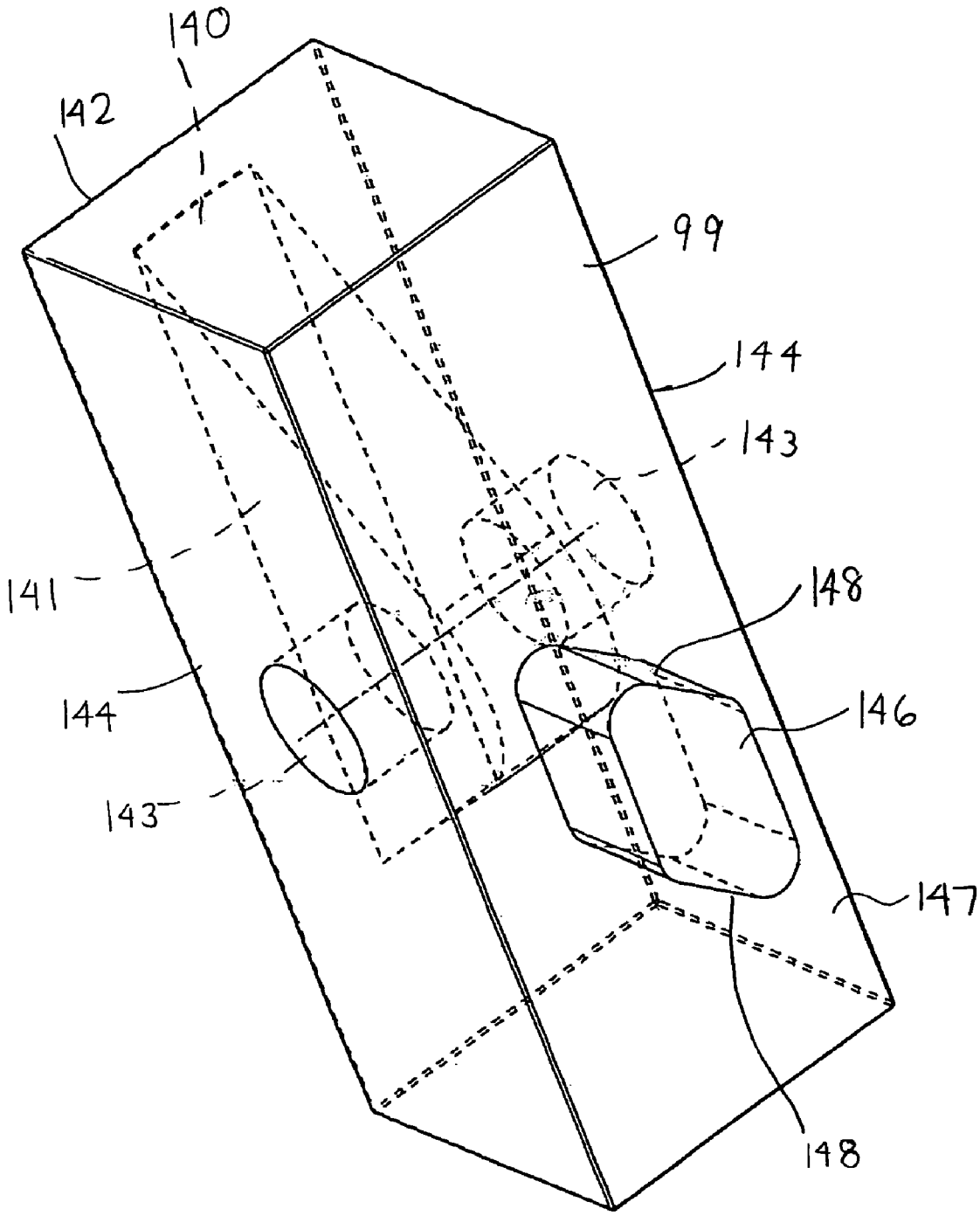
FIG. 10 is a perspective view of a slidable block for the actuator mechanism.

Referring to the slide block 99 of FIG. 10, the slide block 99 includes a generally triangular recess 140 having an opening 141 which opens through the front face 142 of the slide block 99. The recess 140 also includes bores 143 which open through the opposite side walls 144 of the block 99. The recess 140 and bores 143 are adapted to pivotally connect to the front link end 97 as described in further detail herein.

The block 99 also includes a guide projection 146 which projects from the back face 147 of the block 99. The guide projection 146 includes inclined guide surfaces 148 which are formed parallel to each other.

Figure 11:
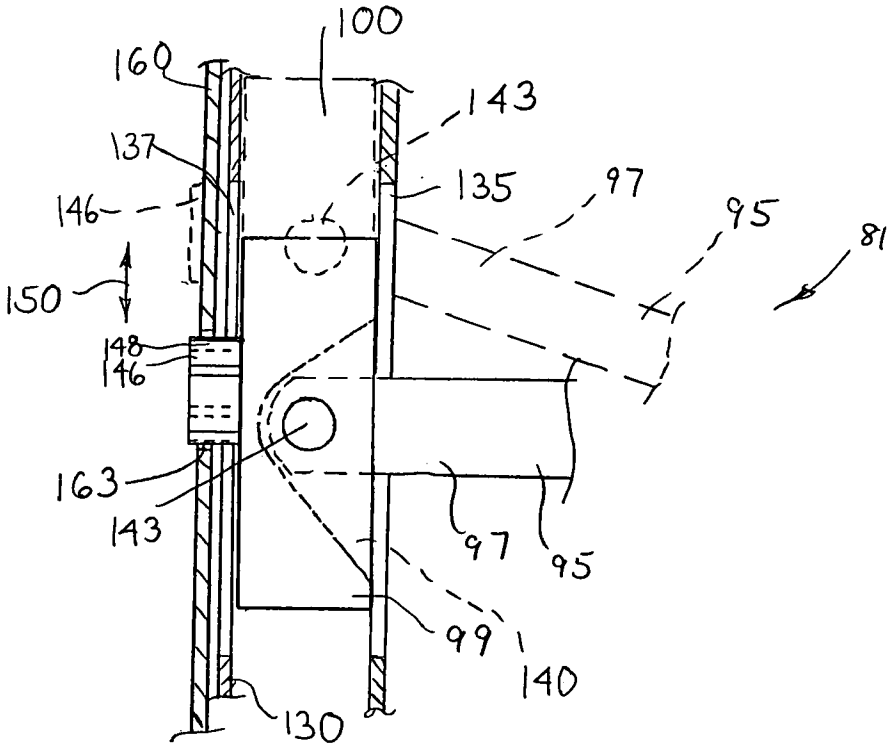
FIG. 11 is a side elevational view in cross-section of the actuator mechanism.
Figure 12:
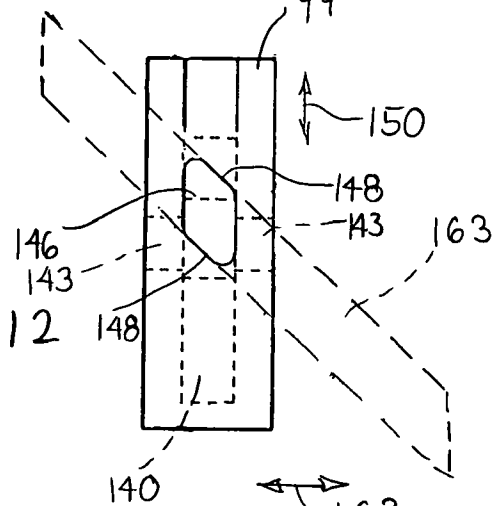
FIG. 12 is a front diagrammatic view of the actuator mechanism.

As referenced previously, the block 99 is confined within the channel 130 so as to be movable vertically as indicated by reference arrows 150 in FIGS. 11 and 12. The front channel 140 is in registry with the slot 135 formed in the front plate 122. Accordingly, the front link end 97 is inserted into the recess 140 through the aligned slots 135 and 140 and then is pivotally connected to the slide block 99 by engagement of a horizontal pivot pin through the pivot bores 143. As such, the front link end 97 moves vertically with the slide block 99 as generally indicated in phantom outline in FIG. 11.

In addition, the guide projection 146 projects rearwardly through the slot 137 formed in the channel member 130. The guide projection 146 is constrained to only be movable vertically and this is provided to effect vertical movement of the block 99 as described hereinafter.

More particularly, a generally L-shaped guide plate 160 is also slidably received within the interior 123 of the front link 130. The drive plate 160 includes an end flange 161 which is oriented generally parallel and faces towards the end face 124 of the link 30. The drive plate 160 is slidable horizontally within the hollow interior 123 as indicated by reference arrow 162 in FIG. 8. The plate 160 also includes an inclined slot 163 which slidably receives the guide projection 146 therein as seen in FIG. 12. When moving the drive plate 160 horizontally sidewardly, the guide projection 146 can only move within the slot 163 but since the guide projection 146 is also constrained within the vertical slot 137, the projection 146 can only move vertically. Therefore, the horizontal movement of the plate 160 effects a corresponding vertical movement of the guide projection 146 as indicated by reference arrow 150.

Figure 9:
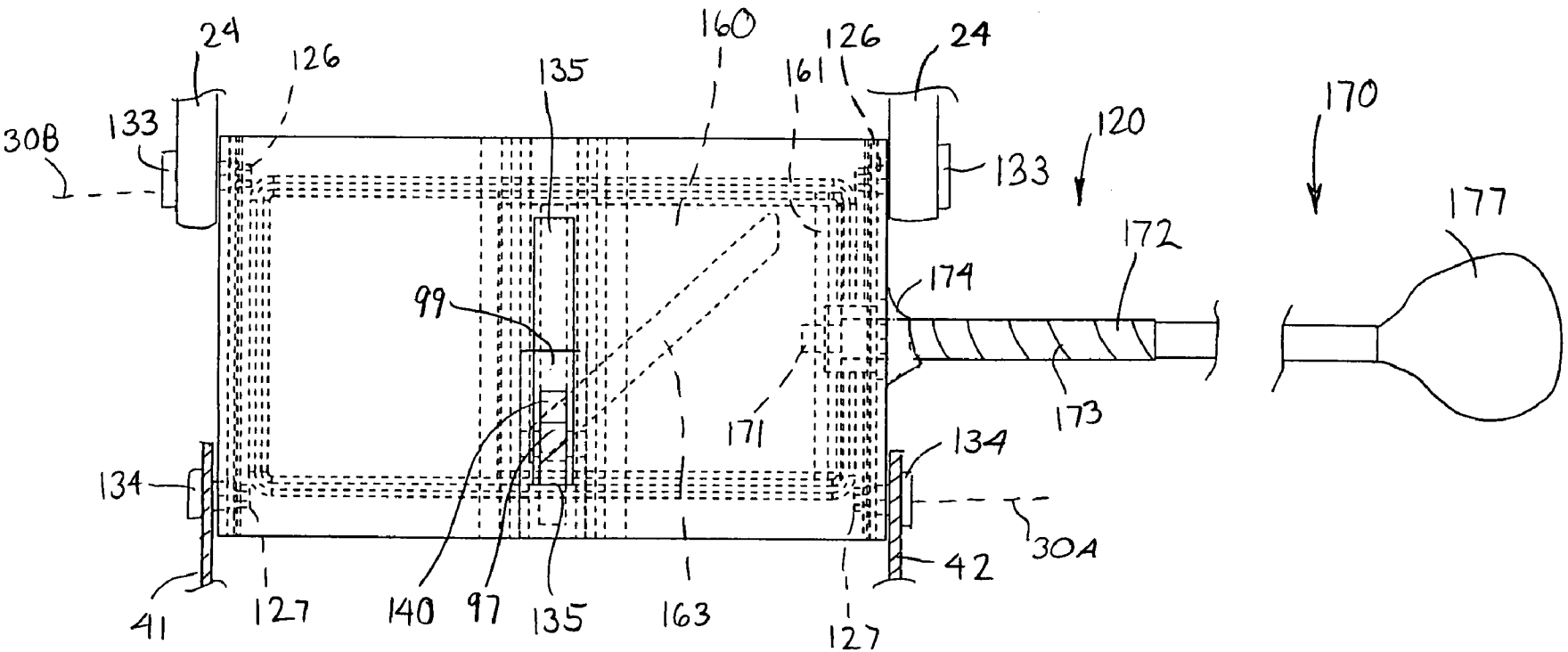
FIG. 9 is a front elevational view of the front link.

To manually move the plate 160, an actuator handle 170 is drivingly connected to the plate 160. In particular, the actuator handle 170 includes an inner end 171 which is fixedly connected to the end flange 161. The actuator handle 170 includes an externally threaded plastic sleeve 172 which includes helical threads 173 thereon. The threaded sleeve 172 is threadedly engaged with a spiral stamped plate 174 that is affixed to the end 124 of the front link 30. Therefore, rotation of the actuator handle 170 as indicated by reference arrow 175 causes an axial displacement of the handle 170 as indicated by reference arrow 176. This therefore causes horizontal displacement of the drive plate 160 which in turn causes the block 99 to move vertically. A suitable knob 177 is provided at the end of the actuator handle 170 as indicated in FIG. 9.

Therefore, rotation of the actuator handle 170 allows the slide block 99 to be raised or lowered vertically to any desired position. This causes the vertical position of the front end 97 of the adjustment link 95 to be adjusted. By adjusting the relative radial distance between the front link end 97 and the pivot axis 30A, the spring output of the spring 80 may be adjusted.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A chair having a seat assembly and a back assembly which are interconnected in a four-bar linkage arrangement, the chair including a base wherein the four-bar linkage arrangement includes a base link fixed to the base and a front link pivotally interconnected to the base link and the seat assembly so as to pivot rearwardly upon tilting of said seat and back assemblies, a tension control mechanism including a spring arrangement comprising a coil spring affixed to the base link and an adjustment linkage having a back linkage end connected to a front end of said coil spring and a front linkage end connected to said front link, said back linkage end being slidable axially along the longitudinal axis of said spring and said front linkage end being slidable vertically along said front link wherein the vertical position of said front linkage end on said front link defines the axial displacement of said back end of said adjustment linkage during rearward pivoting of said front link.

2. The chair according to claim 1, wherein said spring arrangement includes an actuator mechanism which displaces said front linkage end along said front linkage.

3. The chair according to claim 2, wherein said actuator mechanism comprises an actuator handle which is manually actuated to vary the position of said front link end.

4. The chair according to claim 1, wherein said coil spring generates a restoring force acting along said adjustment linkage and forwardly on said front link to resist rearward pivoting of said front link.

5. The chair according to claim 4, wherein said coil spring is compressed during rearward pivoting of said front link to generate said restoring force, and the position of said front link varies the amount of compression of said coil spring and thereby varies the amount of restoring force generated during rearward pivoting.

6. A chair having a seat assembly and a back assembly which are interconnected in a linkage arrangement, the chair including a base wherein the linkage arrangement includes a base link fixed to the base and a front link pivotally interconnected to the base link and the seat assembly so as to pivot rearwardly upon tilting of said seat and back assemblies, said linkage arrangement further comprising said back assembly pivotally interconnected with said base link and said seat assembly to effect said rearward pivoting of said front link, a tension control mechanism including a resilient biasing arrangement comprising an adjustable biasing member affixed to the base link and an adjustment linkage having a back linkage end connected to a front end of said adjustable biasing member and a front linkage end connected to said front link such that said adjustable biasing member generates an adjustable restoring force on said front link which resists said rearward pivoting of said front link, said back linkage end being slidable axially along a longitudinal axis of said adjustable biasing member, and said front linkage end being slidable vertically along said front link wherein the vertical position of said front linkage end on said front link defines the axial displacement of said back end of said adjustment linkage during rearward pivoting of said front link to vary the adjustable restoring force generated by said adjustable biasing member.

7. The chair according to claim 6, wherein said adjustable biasing member is a coil spring disposed in compression between said base link and said adjustment linkage during rearward tilting of said seat and back assembly to generate said adjustable restoring force.

8. The chair according to claim 6, wherein said adjustable biasing member is disposed in a fixed orientation relative to said base link, and said adjustment linkage is pivotally connected to said front link and said adjustable biasing member.

9. The chair according to claim 8, wherein said back linkage end moves linearly along the longitudinal axis of said adjustable biasing member during pivoting of said front link.

10. The chair according to claim 6, wherein said tension control mechanism comprises a fixed-load biasing member which generates a fixed restoring force which resists tilting of said seat and back assemblies in addition to said adjustable restoring force.

11. The chair according to claim 10, wherein said fixed-load biasing member and said adjustable biasing member comprising resiliently deflectable springs.

12. The chair according to claim 6, wherein said front link is pivotally connected to said base link at a first pivot connection, wherein the axial displacement of said back end of said adjustment linkage is increased upon movement of the front linkage end away from said first pivot connection.

* * * * *

UNITED STATES PATENT AND TRADEMARK OFFICE

CERTIFICATE OF CORRECTION

PATENT NO. : 7,281,764 B2
APPLICATION NO. : 10/749309
DATED : October 16, 2007
INVENTOR(S) : Doug Thole It is certified that error appears in the above-identified patent and that said Letters Patent is hereby corrected as shown below:

Column 7, line 62; change “linkage” (second occurrence only) to --link--.

Signed and Sealed this

Twenty-fourth Day of June, 2008

JON W. DUDAS
*Director of the United States Patent and Trademark Office*